United States Patent [19]

Uribe et al.

[11] Patent Number: 5,010,819

[45] Date of Patent: Apr. 30, 1991

[54] BLANKET CLEANING APPARATUS WITH SELECTIVELY ENGAGEABLE FLICKER BAR

[75] Inventors: Diego Uribe, Barrington; Paul Driskill, Elgin; Rolf Hantscho, Lake Zurich, all of Ill.

[73] Assignee: Oxy-Dry Corporation, Itasca, Ill.

[21] Appl. No.: 411,104

[22] Filed: Sep. 22, 1989

[51] Int. Cl.[5] ..... B41F 35/00

[52] U.S. Cl. ..... 101/425; 101/423

[58] Field of Search ..... 101/423, 425, 147; 15/256.52, 256.51, 256.53; 355/302

[56] References Cited

U.S. PATENT DOCUMENTS

| | | | |
|---|---|---|---|
| 3,089,415 | 5/1963 | Grembecki et al. | 101/425 |
| 3,309,993 | 3/1967 | Grembecki et al. | 101/425 |
| 4,015,307 | 4/1977 | Kossak | 101/425 |
| 4,747,348 | 5/1988 | Jeschke et al. | 101/425 |
| 4,841,862 | 6/1989 | Seefried | 101/425 |

FOREIGN PATENT DOCUMENTS

| | | | |
|---|---|---|---|
| 1216252 | 4/1960 | France | 101/147 |
| 112641 | 9/1979 | Japan | 355/302 |
| 257187 | 11/1987 | Japan | 355/302 |
| 2032848 | 5/1980 | United Kingdom | 101/425 |

*Primary Examiner*—Clifford D. Crowder
*Assistant Examiner*—Ren Yan
*Attorney, Agent, or Firm*—Leydig, Voit & Mayer

[57] ABSTRACT

An apparatus for cleaning a surface of a blanket cylinder of a printing press containing having foreign matter thereon including a brush unit with a rotatable brush roller that is selectively moveable into and out of engagement with the surface to be cleaned. The brush unit includes a flicker bar which is moveable in timed relation to movement of the brush unit between an inoperative position removed from the brush and an operative position engaging the brush roller to effect removal of foreign matter carried by the brush roller.

35 Claims, 2 Drawing Sheets

BLANKET CLEANING APPARATUS WITH SELECTIVELY ENGAGEABLE FLICKER BAR

DESCRIPTION OF THE INVENTION

The present invention relates generally to cleaning devices, and more particularly, to a device for cleaning rotating cylindrical surfaces such as, for example, the blankets of blanket cylinders on offset printing presses.

During printing on an offset press, the blankets on the blanket cylinders accumulate foreign matter, such as dried ink or ink build-up, paper, lint, clay, dirt and the like which must be removed to maintain quality printing. As a result thereof, during a specific run or printing job, the blankets must be cleaned at various times. The blankets must also be cleaned to remove the image when a particular printing job is completed.

To be effective, the blanket cleaning device must be capable of removing the foreign matter from the surface being cleaned and then discharging such removed materials from the cleaning device. For this purpose, as shown in U.S. Pat. No. 4,015,307 assigned to the same assignee as the present application, blanket cleaning devices are known which include a cylindrical brush that is engageable with the blanket cylinder and rotatable in an opposite direction to the blanket cylinder. Solvents preferably are applied to the brush during the cleaning cycle to enhance the desired scrubbing action, and a flicker bar is mounted in engaging relation with the underside of the brush for causing the bristles of the brush to flex as they are directed over the flicker bar and eject foreign matter and solvent carried by the brush from the blanket cylinder.

While such blanket cleaning devices have been found to effectively clean blanket cylinders, they have been subject to certain design and operating limitations. Since the brush rotates in an opposite direction to the blanket cylinder and the flicker bar engages the underside of the brush, reactionary forces exerted on the brush by the resistance of the flicker bar increase the pressure by which the brush bears against the blanket cylinder. When the brush strikes a gap in the blanket cylinder between blankets, the brush tends to be suddenly urged forwardly and then bounce rearwardly in reaction thereto. As the speed of the brush increases, so does the bouncing and vibratory action of the brush, which can result in undesirable streaking on the blanket being cleaned. Hence, the speed of the brush rotation must be limited to prevent such undesirable streaking.

In addition, the action of the flicker bar on the brush has been found to remove approximately forty percent of the solvent that is applied to the brush during the cleaning operation. Hence, the blanket washer must be provided with solvent in sufficiently large quantities to compensate for the substantial amount of solvent that is removed by the flicker bar, which increases the operating costs of the unit. Moreover, since rotation of the brush is resisted both by its engagement with the oppositely driven blanket cylinder, as well as the flicker bar, a relatively large drive motor generally is required for the brush, which also contributes to the cost of the unit.

Finally, it is necessary that the cleaning device permit the reliable discharge of solvent and foreign matter removed from the brush without creating a clogged or overflow condition that can cause the brush roller to apply excessive solvent to the moving web, which when carried to the dryer of the printing line can create a potentially dangerous condition.

It is an object of the present invention to provide a blanket cleaning apparatus adapted for more economical and efficient construction and operation.

Another object is to provide a blanket cleaning apparatus as characterized above in which a power driven cleaning brush may be operable at relatively high speeds with less tendency for undesirable vibration, and thus, less tendency for causing streaking in the blanket being cleaned. A related object is to provide such a blanket cleaning apparatus which includes a foreign matter removing flicker bar that does not increase the bearing pressure of the scrubbing brush on the blanket cylinder during a cleaning cycle.

A further object is to provide a blanket cleaning apparatus of the above kind which is adapted to operate with minimum amounts of solvent.

Yet another object is to provide a blanket cleaning apparatus of such type in which the flicker bar is operable for removing primarily foreign matter in the brush and only minimal amounts of solvent.

Another object is to provide such a blanket cleaning apparatus in which the rotatable brush can be driven with a smaller powered drive motor.

Still another object is to provide a blanket cleaning apparatus that permits the reliable discharge of foreign matter and solvent removed from the brush during the cleaning operation and which is adapted for relatively easy cleaning and maintenance.

Other objects and advantages of the invention will become apparent upon reading the following detailed description and upon reference to the drawings, in which.

Figure 3:
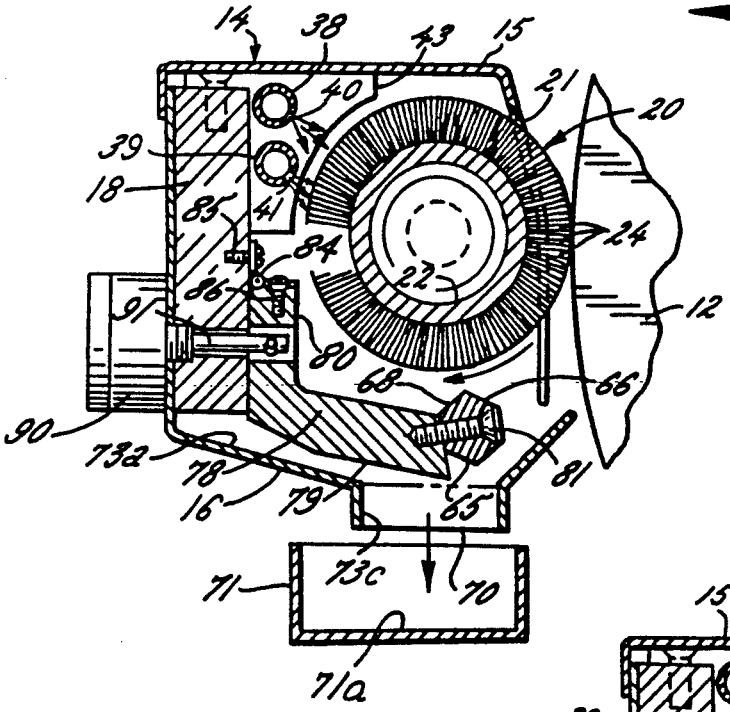
Figure 4:
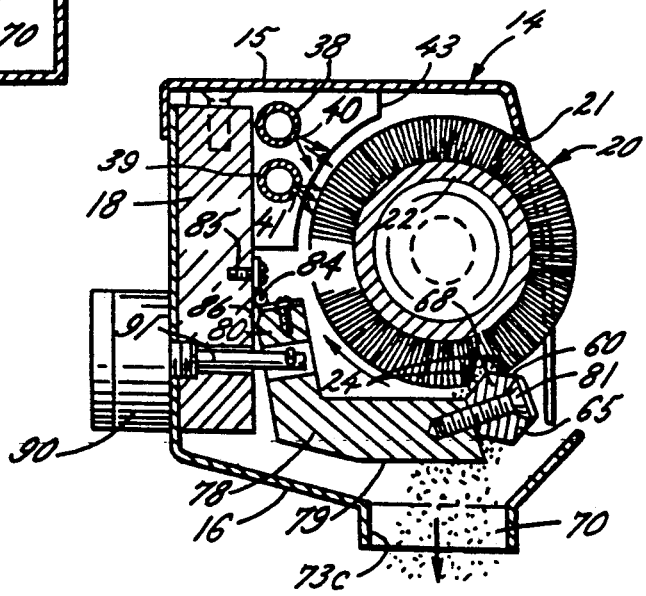

FIG. 3 is an enlarged vertical section of the brush unit of the illustrated cleaning device with the brush in operative engagement with the blanket cylinder of the printing press and with a brush cleaning flicker bar in an inoperative position; and FIG. 4 is a vertical section, similar to FIG. 3, but showing the brush unit of the cleaning device in a retracted or inoperative position relative to the blanket cylinder and the brush cleaning flicker bar in its operative position.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrative cleaning device 10 embodying the present invention mounted between side frame plates 11 of a sheet-fed offset printing press. The cleaning device 10 is located adjacent the blanket cylinder 12 of the printing press, only a fragment of which is shown. The cleaning device 10 includes a brush unit 14 having a housing comprising upper and lower sections 15, 16 mutually secured to a rear support plate 18. A brush roller 20 is rotatably supported within the housing, and the upper and lower housing sections 15,16 define a front opening 21 through which a forward portion of the brush roller 20 extends.

Figure 1:
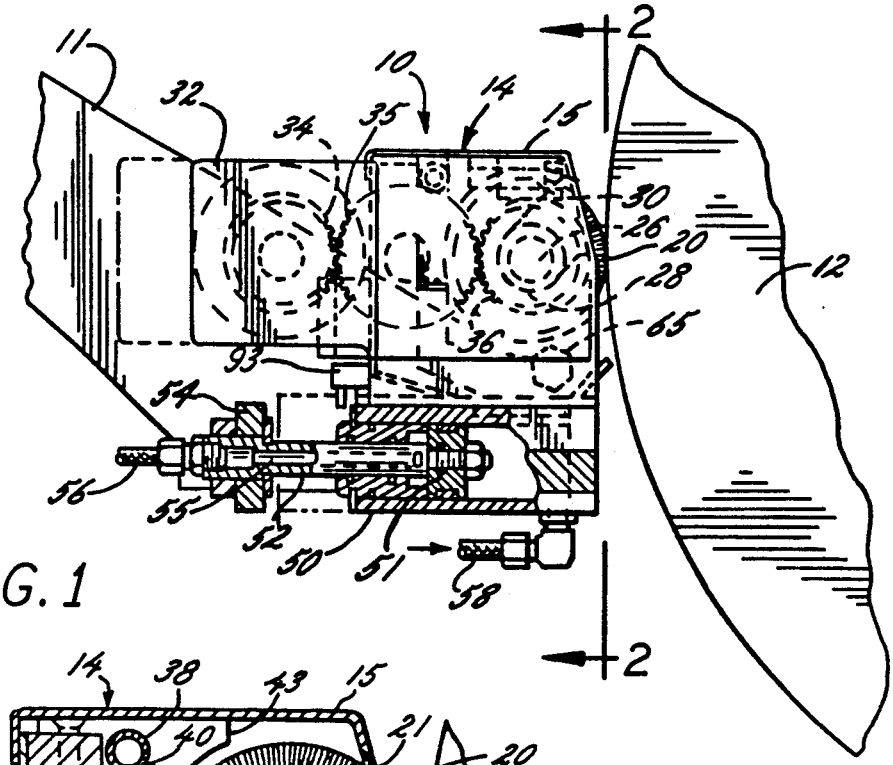
FIG. 1 is an enlarged side elevational view of a cleaning device embodying the present invention, shown in operative relation to a fragmentary portion of the blanket cylinder of a sheet-fed offset printing press, with the inoperative position of the device being indicated in phantom.

The brush roller 20 may be a commercially available type employed in cleaning blanket cylinders. The brush roller 20 in this instance has a cylindrical core 22 with radially extending bristles 24. The bristles 24 must be chemically resistant to the solvents which are employed, sufficiently pliable so that the surface being cleaned is not damaged, and yet sufficiently rigid so that, as will hereinafter be discussed, foreign matter may be removed from the bristles by a flexing action of the bristles. For supporting the brush roller 20, cylindrical inserts 25 (FIG. 2) are provided in opposite ends of the core 22, with the inserts each having an outwardly extending support shaft 26. To enhance servicing of the brush roller 20, it may be mounted in appropriate bearings 28 that are mounted in bearing block support plates 29 located at opposite ends of the housing which are formed with upwardly and outwardly angled shaft receiving slots 30 (FIG. 1). An appropriate removable retaining clamp is provided in the upper end of each slot 30 for maintaining the brush roller 20 in mounted position.

For rotatably driving the brush roller 20, a hydraulic motor 32 in this case is mounted rearwardly of the brush unit housing. The hydraulic motor 32, which may be of a known type, has a drive pinion 34 (FIG. 1) engageable with an intermediate gear 35 supported by the adjacent bearing block support plate 29, which in turn is engageable with a brush roller gear 36 mounted on the shaft 26 at the left hand side of the brush roller 20, as viewed in FIG. 2. The hydraulic motor 32 may be coupled to a suitable pressurized fluid supply source by flexible inlet and return lines so that when pressurized fluid is supplied to the inlet line the motor drives the output pinion 34, which in turn drives the intermediate and brush roller gears 35, 36. The brush roller 20 preferably is driven in a rotary direction opposite that of the surface of the blanket roller being cleaned and at a rate such that effective cleaning is accomplished. The speed at which the brush roller is rotated can be varied within wide limits, the principal criteria being that the speed is sufficiently high to provide effective cleaning in a minimum time.

For applying one or more solvents to the brush roller during a cleaning operation, a pair of parallel solvent distribution tubes 38, 39 are disposed in the upper rear corner of the brush unit housing, as viewed in FIGS. 3 and 4. The solvent distribution tubes 38, 39 are supported between a plurality of laterally spaced support brackets 40 mounted in the corner of the brush unit and each tube 38, 39 is formed with a plurality of laterally spaced holes 40, 41 adapted for directing solvent onto the brush roller 20 on a side opposite the housing opening 21. The number and spacing of holes 40,41 in the distribution tubes 38, 39 should be sufficient to wet the entire length of the brush roller 20. One of the tubes 38 preferably is connected to a water supply in order to permit the blanket to be cleaned first with water to rid the blanket of gum, clay coatings, anti-offset powders and other water soluble materials which may be on the blanket. The other tube 39 may be connected to a supply of organic solvent which may then be applied to the brush roller 20, and thus the blanket, for removing ink and other like remaining substances. The organic solvents utilized may be any of a variety of commercially available solvents, which may, for example, comprise a mixture of aliphatic hydrocarbons, xylene and glycol monoether.

Figure 2:
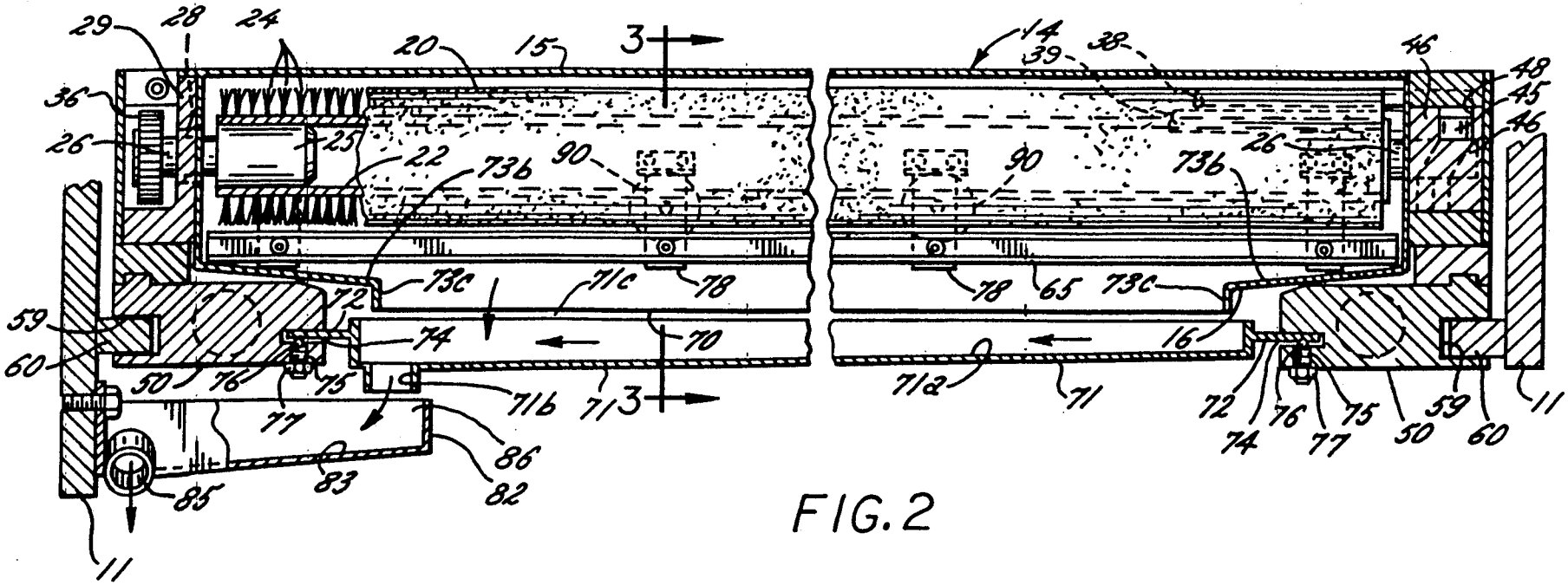
FIG. 2 is an end view, in partial section, taken in the plane of line 2—2 of FIG. 1.

To enhance the scrubbing and cleaning action of the brush roller 20, means are provided for causing the brush roller to oscilate as it is rotating. In the illustrated embodiment, one of the brush roller shafts 26 has an outwardly extending cam follower 45 (FIG. 2). Cam plates 46 mounted on the brush unit housing define and annular cam groove 48 with a predetermined cam profile within which the cam follower 45 is disposed. Upon rotation of the brush roller 20 by its drive assembly, the cam follower 45 rides on the cam profile causing the brush to simultaneously reciprocate in an oscillatory manner. As is known in the art, the drive pinion 34 for the hydraulic motor 32 has sufficient width to accommodate such oscilating movement of the brush roller and its drive gears 35, 36.

For moving the brush unit 14 between an operative position with the brush roller 20 in driving engagement with the blanket cylinder 12 (FIG. 3) and a retracted or inoperative position with the brush roller 20 removed from the blanket cylinder 12 (FIG. 4), a pair of air cylinders 50 are mounted on the underside of the brush unit 14 at opposite ends thereof (FIGS. 1 and 2). Each air cylinder 50 has a piston 51 with a rearwardly extending follower rod 52 affixed to the frame plates 11 of the press by respective brackets 54. Each follower rod 52 in this case is formed with an internal passage 55 that is coupled to a pressurized supply line 56 and communicates with the interior of the cylinder 50 on one side of the piston 51. Introduction of pressurized air through the line 56 causes the housing of the cylinder 50 and the brush unit 14 connected thereto to move from its operative position (FIGS. 1 and 3) to the retracted position (FIG. 4), while the rod 52 remains affixed to the press frame. Introduction of pressurized air through a line 58 in communication with the opposite side of the piston 51 causes return movement of the cylinder 50 and brush unit 14 from the inoperative position to the operative position with the brush roller 20 engaging the blanket cylinder 12. For guiding movement of the brush unit 14 between its operative and retracted positions, the housings of the cylinders 50 are formed with respective outwardly extending guideways 59, which ride on inwardly extending guides 60 affixed to the frame plates 11 of the printing press (FIG. 4).

In accordance with the invention, the blanket cleaning device includes a brush flicker bar that is moveable into engagement with the brush roller when the brush unit is in an inoperative position for removing debris from the bristles of the brush scrubbed from the blanket cylinder and which is moveable to an inoperative position disengaged from the brush roller when the brush unit is moved into operative relation to the blanket cylinder so as to permit operation of the blanket cleaning device without the deflector bar causing the brush roller to create reactionary bearing forces against the blanket cylinder and without the flicker bar impeding or resisting operation of the brush roller while engaged with the blanket cylinder during a cleaning operation. To this end, for removing foreign matter and solvent from the brush roller 20, a flicker bar or blade 65 is provided which desirably extends the length of the brush and is adapted for engaging the underside of the brush roller 20 (FIG. 4). The flicker bar 65 has a first substantially flat surface 66 which is engageable with the underside of the brush in inclined relation to the bristles of the brush roller 20 that are brought into contact with the flicker bar 65 such that the individual bristles 24 are caused to be sequentially and progressively bent as they pass over the flicker bar and then allowed to quickly return to their normal positions so as to effect removal of the solvent and foreign matter from the brush. To permit such quick return movement of the bristles 24, the flicker bar 65 in this instance has a second inclined surface 68 rearwardly of the first surface 66, with the surfaces 66, 68 forming a generally pointed upper portion of the flicker bar 65. By virtue of the direction of motion of the brush roller 20 and the position of the flicker bar 65 on the underside thereof, it can be seen that solvent and foreign matter dislodged from the brush roller 20 as the bristles 24 pass over the flicker bar are deflected downwardly and in a direction away from the front opening 21 of the brush unit 14.

In carrying out the invention, means are provided for moving the support means for the flicker bar between a first position in which the flicker bar is in engagement with the brush roller and a second position removed from the brush roller. In the illustrated embodiment, the flicker bar support means is in the form of plurality of L-shaped arms 78 each having a first generally horizontal leg 79 with the flicker bar 65 mounted at the outer end thereof by bolts 81 and a second upstanding, generally vertical leg 80 pivotably secured to the housing of the brush unit 14 by a hinge plate 84. The hinge plates 84 each have one leg secured to the support plate 18 of the housing by fastening screws 85 and a second leg secured to the end of the upstanding leg 80 of the flicker bar support arm 78.

For pivoting the flicker bar support arms 78 and the flicker bar 65 carried thereby between the first and second positions, a pair of air cylinders 90 are mounted on the rear of the brush unit 14 and each have a respective cylinder rod 91 extending forwardly through housing of the brush unit 14 pivotally coupled to one of the flicker bar support arms 78. It can be seen that upon actuation of the air cylinders 90 the rods 91 are extended to pivot the support arms 78 outwardly with respect to the brush unit support plate 18, raising the deflector bar 65 into interacting relation with the underside of the brush roller 20. Deactuation of the air cylinders 90 permits retraction of the cylinder rods 91 and return of the upstanding legs 80 of the support arm 78 to a position immediately adjacent the support plates 18 defining the rear wall of the brush unit 14, which lowers the flicker bar 65 to a position out of engagement with the brush roller 20 (FIG. 3).

In keeping with a further aspect of the invention, control means is provided for controlling the operation of the flicker bar support arm moving means such that the flicker bar is moved in to engaging relation with the brush roller in timed relation to movement of the brush unit toward its retracted or inoperative position. In the illustrated embodiment, upon initiation of retracting movement of the brush unit 14 upon actuation of the cylinders 50, a limit switch 93 mounted on the press frame arms 11 is engaged by the brush unit 14, which imparts a signal for triggering operation of the flicker bar actuating air cylinders 90. Likewise, deactuation of the air cylinders 90, and thus retraction of the flicker bar 65, may be controlled by return movement of the brush unit 14 toward the blanket cylinder 12. Alternatively, a microprocessor based control may be used for actuating the brush unit cylinder 50 and the flicker bar actuating cylinders 90 in the desired timed relation. Preferably, the flicker bar is moved into engaging relation with the brush roller promptly upon initiation of retracting movement of the brush roller, and is returned to its retracted position prior to re-engagement of the brush roller with the blanket cylinder.

In carrying out still a further feature of the invention, means are provided for effecting the reliable discharge of removed foreign matter and solvent ejected from the brush by the flicker bar and for permitting easy cleaning and maintenance of the device. For channeling solvent and foreign matter removed from the brush roller 20 by the flicker bar 65 and directing such materials away from the brush unit 14, the lower housing section 16 of the brush unit 14 has a trough-like form with an elongated, bottom discharge opening 70 extending substantially the length of the brush roller 20. In the illustrated embodiment, the discharge opening 70 has an elongated rectangular configuration defined by a pair of downwardly tapered side walls **73*a*, which direct solvent and foreign matter to a location immediately below the brush roller 20 and a pair of downwardly tapered end walls 73*b* that extend under the respective opposite ends of the brush roller 20 relatively short distances so as to channel solvent and foreign matter inwardly over the cylinders 50 to the discharge opening 70. The tapered side and end walls 73*a*, 73*b* each terminate in a depending vertical lip 73*c*. Hence, foreign matter and solvent being ejected from the brush roller 20 by the flicker bar 65 is caused to be directed to and through the relatively large discharge opening 70** immediately below the brush roller.

For receiving and channeling solvent and foreign matter discharging from the housing discharge opening 70, a drain tray 71 is removably supported in vertically spaced relation immediately below the discharge opening 70. The drain tray 71 in this instance has a pair of outwardly extending arms 72 at opposite ends thereof that are received in respective inwardly opening slots 74 in the housings of the air cylinders 50. Releasable retaining means are provided for securing the arms 72 in mounted position. The retaining means in this case include spring loaded retainers which each comprise a screw 75 threaded in engagement in an aperture extending from the underside of the housing of the respective cylinder 50 into the arm receiving slot 74. The upper end of the screw 75 is recessed for housing a spring biased detent ball 76, which will releasably engage a detent or aperture formed in the underside of the arm 72 upon positioning of the arms 72 into the slots 74. A retaining nut 77 secures the screw 75 in mounted position.

The drain tray 71 has an open top rectangular configuration which completely underlies the housing discharge opening 70. The drain tray 71 has a bottom panel **71*a* tapered downwardly to the left, as viewed in FIG. 2, for directing solids and fluids toward a drain opening 71*b* adjacent the end of the tray. The drain tray 71 preferably is configured such that the upper peripheral edge 71*c* thereof is disposed in spaced relation below the lower peripheral edge of the discharge opening lip 73*c*. Such clearance between the drain tray 71 and the discharge opening lip 73*c* permits relatively easy removal and replacement of the drain tray 71, and in the unlikely event that the drain 71*b* should became clogged, the accumulation of solvent and foreign within the drain tray 71 can rise only to the upper level of the drain tray, thereby preventing a condition in which the underside of the brush roller 20** might contact accumulated solvent and cause excessive amounts of solvent to be applied to the moving web.

The drain tray 71 in the illustrated embodiment discharges into a drain trough 82 supported in cantilever fashion from the side frame plate 11 on the left hand side of the unit, as viewed in FIG. 2. The drain trough 82 has a bottom wall 83 that is tapered downwardly to a drain 85 which may be coupled to a suitable discharge line for directing the solvent and foreign matter to an appropriate filter and separating device in order to permit reuse of the solvent. The upper peripheral edge 86 of the drain trough 82 again is disposed in vertically spaced relation below the lower peripheral edge of the drain **71*b* so as to prevent interference with removal and replacement of the drain tray 71**.

In operation of the blanket cleaning device 10, when the blankets on the cylinder 12 are to be cleaned, the brush unit 14 may be moved from its inoperative position (FIG. 4) to its operative position (FIGS. 1 and 3) through actuation of the air cylinders 50 so as to bring the brush roller 20 into engagement with the blanket cylinder 12. The drive for the brush roller is activated through operation of the hydraulic motor 32 to rotate the brush roller 20 in a direction opposite to the direction of rotation of the blanket cylinder 12 to effect the washing operation. Water and organic solvents preferably are sequentially directed on to the brush roller 20 for application to the blanket cylinder through the respective solvent distribution tubes 38, 39. At the same time, scrubbing of the blanket cylinder is enhanced by the oscillatory movement of the brush roller 20 imparted through the cam and follower arrangement 46, 45 of the brush drive. During such washing and scrubbing operation, the flicker bar 65 is in its inoperative or retractive position, as shown in FIG. 3, and hence, does not cause the brush roller 20 to impart increased reactionary bearing forces against the cylinder 12, nor cause the premature removal of solvents from the brush roller 20 during the course of the cleaning operation, nor resist the driving motion of the brush roller, as is typical of prior art blanket washers.

Following completion of the blanket cleaning operation, the brush unit 14 may be moved from its operative position (FIG. 3) to its retracted position (FIG. 4) upon actuation of the air cylinders 50, an in timed relation thereto, the flicker bar 65 may be moved from its inoperative position (FIG. 3) to its operative position in engagement with the brush roller 20 (FIG. 4). Continued rotary movement of the brush roller 20 by its drive results in the flicker bar 65 removing foreign matter and solvent from the brush by the flicking action of the brush bristles 24 sequentially passing over the flicker bar surface 66. Since the brush roller 20 is in its inoperative position during the brush cleaning operation with solvent through the distribution tubes 38, 39 discontinued, only the solvent remaining on the brush roller following the blanket cleaning operation is removed. Because the brush roller 20 is disengaged from the blanket cylinder 12, the brush roller 20 also may be driven during the brush cleaning cycle without the resistance of the brush roller being engaged with the blanket cylinder. Solvent and foreign matter ejected from the brush roller during the cleaning operation is reliably discharged from the device through the elongated bottom discharge opening 70 in the lower housing section 16, which discharges into the removable drain tray 71 and in turn into the trough 82.

From the foregoing, it has been found that the brush roller of the blanket cleaning device of the present invention may be operated at relatively high speeds with less tendency for undesirable vibration, and hence, less tendency for causing streaking in the blanket being cleaned. Since the flicker bar remains disengaged from the brush roller during the actual cleaning cycle, lesser amounts of solvents are required during the cleaning cycle, and the brush roller may be driven with a smaller powered motor. The drain tray disposed below the brush unit is easily removable for cleaning and maintenance for insuring the reliable discharge of solvent and foreign matter removed from the brush during a blanket cleaning operation. Hence, the blanket cleaning apparatus has been found to be susceptible to both economical manufacture and efficient operation.

I claim as my invention:

1. An apparatus for cleaning a surface of a cylinder of a printing press having undesired foreign matter thereon comprising scrub means including a rotatable brush roller having a longitudinal axis and radially extending bristles, means for moving said rotatable brush roller into and out of engagement with the surface to be cleaned, means for applying cleaning fluid to said cylinder surface to facilitate removal of foreign matter from said surface when said brush roller is in engagement with said surface, a flicker bar mounted for movement between an inoperative position removed from the bristles of said brush roller and an operative position engaging the brush roller such that the bristles thereof pass over the flicker bar and are flexed to effect removal of cleaning fluid and foreign matter carried by the bristles, and means for moving said flicker bar between said operative and inoperative positions, said flicker bar moving means being operable in timed relation to said brush roller moving means whereby said flicker bar is moveable into engaging relationship with said brush roller for removing cleaning fluid and foreign matter from the bristles of the brush roller while said brush roller is out of engagement with the surface to be cleaned.

2. The cleaning apparatus of claim 1 in which said flicker bar moving means includes means for moving said flicker bar into engagement with said brush roller in response to movement of said brush roller out of contact with the surface to be cleaned.

3. The cleaning apparatus of claim 1 in which said flicker bar has a substantially flat surface, which upon movement of said flicker bar to its operative position, is in inclined relation to the bristles of the brush roller passing over said flicker bar.

4. The cleaning apparatus of claim 3 in which said flicker bar, upon movement to its operative position, engages in an underside of said brush roller.

5. The cleaning apparatus of claim 1 including flicker bar support means, and said means for moving said flicker bar includes means for moving said support means between first and second positions.

6. The cleaning apparatus of claim 5 in which said flicker bar support means includes at least one support arm, said flicker bar being mounted at an end of said arm, and means for pivotally mounting the other end of said arm for permitting movement of said flicker bar with respect to said brush roller.

7. The cleaning apparatus of claim 5 in which said scrub means includes a brush unit having a housing within which said brush roller is rotatably disposed, and said flicker bar support means is disposed within said housing.

8. The cleaning apparatus of claim 1 in which said cleaning fluid applying means includes means for supplying cleaning fluid to the bristles of the brush roller.

9. The cleaning apparatus of claim 8 in which said cleaning fluid supplying means includes at least one cleaning fluid distribution tube supported in parallel relation to said brush roller, said cleaning fluid distribution tube being formed with a plurality of longitudinally spaced apertures for directing a plurality of cleaning fluid flowstreams onto said brush roller along the length thereof.

10. The cleaning apparatus of claim 1 including means defining an elongated discharge opening below said brush roller which extends substantially the length of said brush roller and through which cleaning fluid and foreign matter removed from said brush roller is directed, a drain tray having a drain opening, and means removably supporting said drain tray in spaced relation below said discharge opening for receiving and directing cleaning fluid and foreign matter passing through said discharge opening.

11. The cleaning apparatus of claim 10 in which said drain tray has a drain opening through which cleaning fluid and foreign matter received from said discharge opening is directed, and a trough disposed in spaced relation below said drain tray for receiving cleaning fluid and foreign matter directed through aid drain opening.

12. The cleaning apparatus of claim 11 in which said flicker bar moving means includes means for moving said flicker bar into engagement with said brush roller in response to movement of said brush unit toward said inoperative position.

13. The cleaning apparatus of claim 11 in which said flicker bar, when in its operative position, has a first substantially flat surface disposed at an angle to the bristles of the brush roller passing over said flicker bar such that the said bristles sequentially engage by said surface and are flexed.

14. The cleaning apparatus claim 13 in which said flicker bar includes a second substantially flat surface disposed rearwardly of said first surface, said first and second surfaces forming a generally pointed upper end of said flicker bar when said flicker bar is in its operative position.

15. An apparatus for cleaning a surface of a blanket cylinder of a printing press having undesired foreign matter thereon comprising a brush unit including a rotatable brush roller having a longitudinal axis and substantially radially extending bristles, means for moving said brush unit between an operative position with said brush roller in contact with the surface to be cleaned and an inoperative position with said brush roller removed from said surface, means for applying cleaning fluid to said cylinder surface to facilitate removal of foreign matter from said surface when said brush unit is in said operative position, a flicker bar mounted for movement between an inoperative position removed from the bristles of said brush roller and an operative position engaging the brush roller such that the bristles thereof pass over the flicker bar and are flexed to effect removal of cleaning fluid and foreign matter carried by the bristles, and means for moving said flicker bar between said flicker bar inoperative and operative positions, said flicker bar moving means being operable in timed relation to said brush roller moving means whereby said flicker bar is moveable into engaging relationship with said brush roller for removing cleaning fluid and foreign matter from the bristles of the brush roller while said brush roller is out of engagement with the surface to be cleaned.

16. The cleaning apparatus of claim 15 including flicker bar support means, and said means for moving said flicker bar includes means for moving said support means between first and second positions.

17. The cleaning apparatus of claim 16 in which said brush unit includes a housing within which said brush roller is mounted for rotary movement, said flicker bar support means including at least one arm, said flicker bar being mounted at one end of said arm, and means for securing another end of said arm to said housing for relative pivotal movement between a first position in which said flicker bar is engaged with said brush roller and a second position in which said flicker bar is removed from said brush roller.

18. The cleaning apparatus of claim 16 in which said brush unit includes a housing within which said brush roller is mounted for rotary movement said flicker bar support means including at least one L-shaped arm having an upstanding leg and a generally horizontal leg, said flicker being mounted on said horizontal leg, and means connecting said upstanding leg to said housing for relative pivotal movement.

19. The cleaning apparatus of claim 17 in which said means for moving said flicker bar support means includes at least one cylinder mounted on said brush unit housing and having a piston rod connected to said flicker bar support means whereby actuation of said cylinder moves said flicker bar to said flicker bar operative position.

20. The cleaning apparatus of claim 15 including drive motor means mounted on said brush unit for rotating said brush roller.

21. The cleaning apparatus of claim 20 in which said drive motor means is a hydraulic motor.

22. The cleaning apparatus of claim 20 including press frame means, and said means for moving said brush unit between said operative and inoperative positions is a cylinder coupled between said brush unit and said press frame means.

23. The cleaning apparatus of claim 15 in which said cleaning fluid applying means includes means for supplying cleaning fluid to the bristles of said brush roller.

24. The cleaning apparatus of claim 22 in which said brush unit includes a housing which defines a front opening, said brush roller being disposed within said housing with a portion thereof extending outwardly of said front opening, and said cleaning fluid supplying means is operable for directing cleaning fluid on to a side of said brush roller opposite said portion extending out of said housing opening.

25. The blanket washing apparatus of claim 24 in which said cleaning fluid supplying means includes a first distribution tube extending the length of said brush unit for directing water on to said brush roller and a second distribution tube mounted in parallel relation to said first tube for directing an organic solvent on to said brush roller.

26. A cleaning apparatus of claim 24 in which said brush unit housing defines a discharge opening in the underside thereof through which cleaning fluid and foreign matter removed from said brush roller is directed, and further including a drain tray removably mounted on the underside of said brush unit housing for receiving and directing cleaning fluid foreign matter passing through the discharge opening.

27. The cleaning apparatus of claim 15 in which said brush unit has a housing having a bottom discharge opening below said brush roller and a drain tray removably mounted on the underside of said brush unit housing for receiving and directing foreign matter passing through said discharge opening.

28. The cleaning apparatus of claim 27 in which said discharge opening extends substantially the entire length of said brush roller.

29. The cleaning apparatus of claim 28 in which said drain tray has an upper periphery disposed below the lower periphery of said discharge opening.

30. The cleaning apparatus of claim 1 in which said brush roller has radially extending bristles which are chemically resistant to the cleaning fluid applied, are sufficiently pliable so to prevent damage to the surface of the cylinder, and are sufficiently rigid so that cleaning fluid and foreign matter on the bristles may be removed by flexing action of the bristles effected by passage of the bristles over the flicker bar when the flicker bar is in said operative position.

31. The cleaning apparatus of claim 15 in which said brush roller has radially extending bristles which are chemically resistant to the cleaning fluid applied, are sufficiently pliable so to prevent damage to the surface of the cylinder, and are sufficiently rigid so that cleaning fluid and foreign matter on the bristles may be removed by flexing action of the bristles effected by passage of the bristles over the flicker bar when the flicker bar is in said operative position.

32. An apparatus for cleaning a surface of a cylinder of a printing press having undesired foreign matter thereon comprising scrub means including a rotatable brush roller having outwardly extending bristles, means for moving said rotatable brush roller into and out of engagement with the surface to be cleaned, means for applying cleaning fluid to said cylinder surface to facilitate removal of foreign matter from said surface when said brush roller is in engagement with said surface, a flicker bar, and means for effecting relative movement of said flicker bar and brush roller between first relative positions in which said flicker bar is in removed relation from the bristles of said brush and second relative positions in which the flicker bar is in engaging relation with the brush roller such that the bristles thereof pass over the flicker bar and are flexed to effect removal of cleaning fluid and foreign matter carried by the bristles, said means for effecting relative movement of said flicker bar and brush roller being operable in timed relation to said brush roller moving means whereby said flicker bar and brush reoller are moveable into engaging relation for removing cleaning fluid and foreign matter from the bristles of the brush roller while said brush roller is out of engagement with the surface to be cleaned.

33. The cleaning apparatus of claim 32 in which said relative movement effecting means is operable for moving said flicker bar and brush roller to said second relative positions in response to movement of said brush roller to a position out of engagement with the surface to be cleaned.

34. The cleaning apparatus of claim 32 in which said flicker bar has a substantially flat surface that is in inclined relation to the bristles of the brush roller passing over the flicker bar when said flicker bar and brush roller are in said second relative positions.

35. The cleaning apparatus of claim 34 in which said flicker bar engages an underside of said brush roller when said flicker bar and brush roller are in said second relative positions.

* * * * *